US007647016B2

(12) United States Patent
Saiki

(10) Patent No.: US 7,647,016 B2
(45) Date of Patent: Jan. 12, 2010

(54) FIXING DEVICE AND IMAGE FORMING APPARATUS USING THE SAME

(75) Inventor: Mikio Saiki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 140 days.

(21) Appl. No.: 11/853,853

(22) Filed: Sep. 12, 2007

(65) Prior Publication Data

US 2008/0219725 A1 Sep. 11, 2008

(30) Foreign Application Priority Data

Mar. 5, 2007 (JP) ..... 2007-053768

(51) Int. Cl.
*G03G 15/20* (2006.01)

(52) U.S. Cl. ..... 399/329; 399/328; 399/331; 219/216; 219/469

(58) Field of Classification Search ..... 399/45, 399/67, 328, 329, 330, 331, 332; 219/216, 219/469–471
See application file for complete search history.

(56) References Cited

U.S. PATENT DOCUMENTS 3,934,113 A * 1/1976 Bar-on ..... 219/216
5,999,788 A 12/1999 Kanesawa et al.
2002/0085866 A1* 7/2002 Okayasu et al. ..... 399/328
2005/0123328 A1* 6/2005 Aruga et al. ..... 399/328
2006/0257180 A1* 11/2006 Nakagawa et al. ..... 399/329
2008/0107436 A1* 5/2008 Mikutsu ..... 399/67
2008/0131179 A1* 6/2008 Tsunoda ..... 399/331

FOREIGN PATENT DOCUMENTS

JP 359105668 A * 6/1984
JP 10-228200 A 8/1998
JP 11-2987 A 1/1999
JP 11-133776 A 5/1999

* cited by examiner

*Primary Examiner*—David M Gray
*Assistant Examiner*—Barnabas T Fekete
(74) *Attorney, Agent, or Firm*—Sughrue Mion, PLLC

(57) ABSTRACT

A fixing device, includes: a heating member that rotates in a state heated by a heating unit; a driven member that is rotated by the heating member, and that conveys a sheet in cooperation with the heating member; a biasing unit that biases the heating member and the driven member in a contacting direction; a contact area forming member that forms a contact area of the heating member and the driven member by making the heating member and the driven member come in contact with each other; a support member that supports at least one of the heating member and the driven member so as to be freely moved in a direction approaching and separated with respect to the other member; and a fulcrum that is arranged in a downstream side of the contact area in a sheet conveying direction, and that movably supports the support member.

11 Claims, 15 Drawing Sheets

FIXING DEVICE AND IMAGE FORMING APPARATUS USING THE SAME

CROSS-REFERENCE TO RELATED APPLICATION

This application is based on and claims priority under 35 USC 119 from Japanese Patent Application No. 2007-053768 filed Mar. 5, 2007.

BACKGROUND

Technical Field

This invention relates to a fixing device and an image forming apparatus using this fixing device.

SUMMARY

According to an aspect of the invention, there is provided a fixing device, including: a heating member that rotates in a state heated by a heating unit; a driven member that is rotated by the heating member, and that conveys a sheet in cooperation with the heating member; a biasing unit that biases the heating member and the driven member in a contacting direction; a contact area forming member that forms a contact area of the heating member and the driven member by making the heating member and the driven member come in contact with each other; a support member that supports at least one of the heating member and the driven member so as to be freely moved in a direction approaching and separated with respect to the other member; and a fulcrum that is arranged in a downstream side of the contact area in a sheet conveying direction, and that movably supports the support member.

BRIEF DESCRIPTION OF THE DRAWINGS

Exemplary embodiments of the present invention will be described in detail based on the following figures, wherein.

DETAILED DESCRIPTION

An exemplary embodiment mode of this invention will next be explained with reference to the drawings.

Exemplary Embodiment Mode 1

Figure 2:
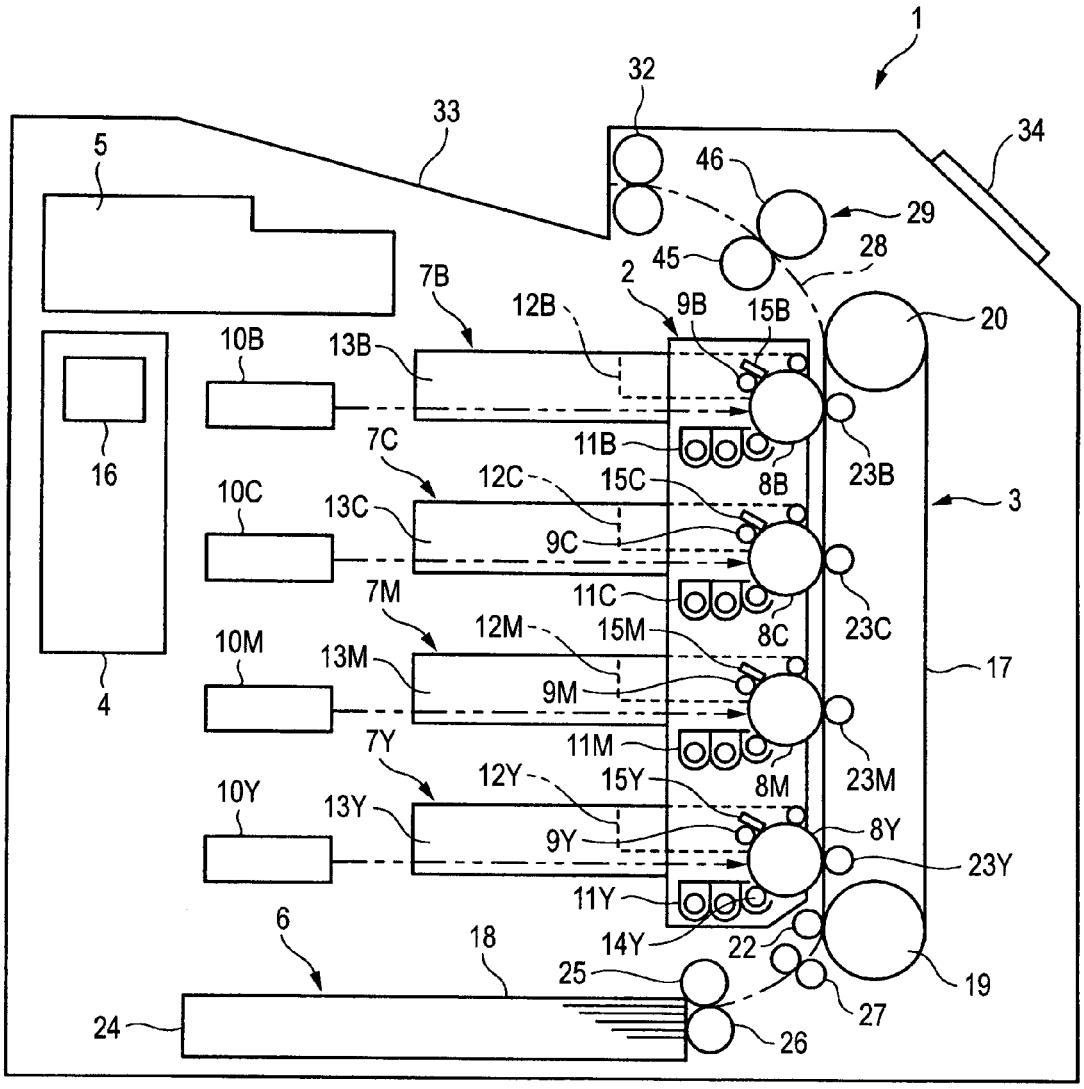
FIG. 2 illustrates a constructional view showing a full color printer of a tandem type as an image forming apparatus applying the fixing device in accordance with exemplary embodiment mode 1 of this invention.

FIG. 2 shows a full color printer of a tandem type as an image forming apparatus applying a fixing device in accordance with exemplary embodiment mode 1 of this invention thereto. For example, this full color printer is constructed so as to execute a print operation on the basis of image data sent from a personal computer, a scanner, etc. The image forming apparatus may be also constructed as a copying machine and a facsimile having a scanner, or a composite machine having these functions, etc.

In FIG. 2, reference numeral 1 designates a main body of the full color printer of the tandem type. In the interior of this full color printer main body 1, an image forming unit 2 is arranged along the vertical direction approximately in its central portion. Further, in the interior of the full color printer main body 1, a paper sheet conveying belt unit 3 is arranged in one side (right-hand side in the illustrated example) of the image forming unit 2. The paper sheet conveying belt unit 3 conveys a paper sheet transferring a toner image of plural colors formed in the image forming unit 2 in an adsorbing state. Further, a control unit 4 having a control circuit, etc. is arranged in the other side (left-hand side in the illustrated example) of the image forming unit 2. An electric power circuit unit 5 having a high voltage electric power circuit, etc. is arranged in a slanting upward direction of the image forming unit 2. Further, a paper feeder 6 for feeding a transferred paper sheet 18, etc. is arranged in a bottom portion within the above full color printer main body 1.

The above image forming unit 2 sequentially has four image forming sections 7Y, 7M, 7C, 7B for forming toner images of the respective colors of yellow (Y), magenta (M), cyan (C) and black (B) from below. These four image forming sections 7Y, 7M, 7C, 7B are spaced at a constant interval along the vertical direction and are arranged in series.

All these four image forming sections 7Y, 7M, 7C, 7B are similarly constructed except for the colors of a formed image. As shown in FIG. 2, the image forming section is generally constructed from a photosensitive drum 8 rotated at a predetermined rotating speed along an arrow direction, a charging roll 9 for primary charging for uniformly charging the surface of this photosensitive drum 8, an image exposing device 10 for exposing an image corresponding to each color on the surface of the photosensitive drum 8 and forming an electrostatic latent image, a developing device 11 for developing the electrostatic latent image formed on the photosensitive drum 8 by toner of a corresponding color, a cleaning device 12 for cleaning the transfer remaining toner left on the photosensitive drum 8, and a toner cartridge 13 for supplying toner to the developing device 11.

In the above developing device 11, as shown in FIG. 2, while a developing agent of two components or one component stored in the interior is agitated, this developing agent is supplied to a developing roll 14. While the thickness of a layer of the developing agent supplied to the developing roll 14 is regulated, conveyance to a developing area opposed to the photosensitive drum 8 is performed, and the electrostatic latent image formed on the surface of the photosensitive drum 8 is developed by the toner of a predetermined color.

Further, as shown in FIG. 2, the above cleaning device 12 removes the transfer removing toner left on the surface of the photosensitive drum 8 by a cleaning blade 15, and conveys and stores the removed transfer remaining toner into the cleaning device 12.

Further, as shown in FIG. 2, the control unit 4 is arranged within the above full color printer main body 1. For example, an image processor 16 for performing predetermined image processing with respect to image data is arranged in this control unit 4. Image data of the respective colors of yellow (Y), magenta (M), cyan (C) and black (B) are sequentially outputted from this image processor 16 to each image exposing device 10. Four laser beams LB emitted from each of these image exposing devices 10 in accordance with the image data are scanned and exposed on the respective photosensitive drums 8Y, 8M, 8C, 8B and an electrostatic latent image is formed. The electrostatic latent image formed on each of the photosensitive drums 8Y, 8M, 8C, 8B is respectively developed as a toner image of each color of yellow (Y), magenta (M), cyan (C) and black (B) by the developing devices 11Y, 11M, 11C, 11R.

Further, as shown in FIG. 2, the above paper sheet conveying belt unit 3 has a paper sheet conveying belt 17 circulated and moved without a rift as an endless shape belt. The paper sheet conveying belt 17 is constructed so as to convey the paper sheet 18 as a sheet transferring the toner image of each color of yellow (Y), magenta (M), cyan (C) and black (B) formed in the respective image forming sections 7Y, 7M, 7C, 7B in a state electrostatically adsorbed.

As shown in FIG. 2, the above paper sheet conveying belt 17 is extended in predetermined tension between a driving roll 19 and a driven roll 20 as an extending roll arranged along the vertical direction. The paper sheet conveying belt 17 is constructed so as to be circulated and moved along the clockwise direction at a predetermined speed by the driving roll 19 rotated and operated by an unillustrated drive motor.

For example, the distance between the above driving roll 19 and driven roll 20 is set to a length approximately equal to the length of the paper sheet 18 of size A3. However, the distance between the driving roll 19 and the driven roll 20 is not limited to this length, but may be arbitrarily set. For example, a structure in which a synthetic resin film of polyimide, etc. having a flexible property is formed in an endless belt shape is used as the above paper sheet conveying belt 17.

Further, as shown in FIG. 2, an adsorbing roll 22 for electrostatically adsorbing the paper sheet 18 to the surface of the paper sheet conveying belt 17 is arranged so as to abut on the surface of the above driving roll 19 through the paper sheet conveying belt 17. For examples similar to the charging roll 9 of the image forming sections 7Y, 7M, 7C, 7B, this adsorbing roll 22 is constructed by covering the surface of a cored bar manufactured by a metal with electrically conductive rubber. A predetermined bias voltage for adsorption is applied to the cored bar manufactured by a metal. The adsorbing roll 22 is constructed such that the paper sheet 18 sent from the paper feeder 6 is electrostatically charged and is adsorbed to the surface of the paper sheet conveying belt 17. The above adsorbing roll 22 may not be necessarily arranged.

As shown in FIG. 2, the toner image of each color of yellow (Y), magenta (M), cyan (C) and black (B) formed on the photosensitive drums 8Y, 8M, 8C, 8B of the above respective image forming sections 7Y, 7M, 7C, 7B is transferred in multiplex in a state overlapped with each other by transfer rolls 23Y, 23M, 23C, 23B on the paper sheet 18 conveyed in a state adsorbed to the surface of the paper sheet conveying belt 17. The above transfer rolls 23Y, 23M, 23C, 23B are integrally attached to the paper sheet conveying belt unit 3.

As shown in FIG. 2, the above paper sheet 18 is fed from the paper feeder 6 arranged in a bottom portion of the printer main body 1. This paper feeder 6 has a paper sheet tray 24 for storing the paper sheet 18 of predetermined desirable size and material. The paper sheet 18 of predetermined desirable size and material is fed from the paper sheet tray 24 by a feed roll 25, and is fed in a state separated by a handling roll 26 one by one. The paper sheet 18 is then conveyed to an adsorbing position on the paper sheet conveying belt 17 in predetermined timing through a resist roll 27 as a paper feed unit.

Various materials of a sheet shape of various sizes e.g., sizes A4, A3, or B5, B4, etc. and ordinary paper, thick paper of coat paper, a postcard, etc., an OHP sheet, or thin paper of tracing paper, etc. are used as the above paper sheet 18.

Figure 3:
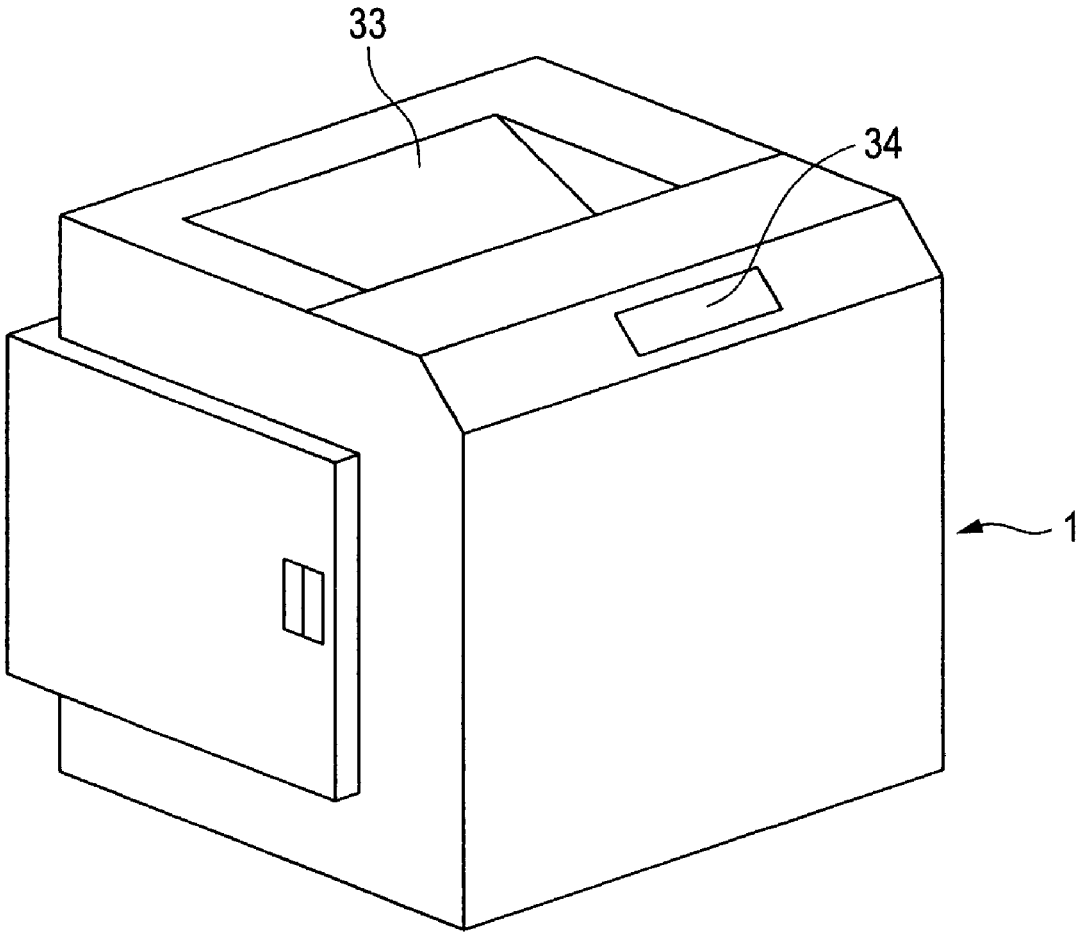
FIG. 3 illustrates an external appearance perspective view showing the full color printer of the tandem type as the image forming apparatus applying the fixing device in accordance with exemplary embodiment mode 1 of this invention.

As shown in FIG. 2, the paper sheet 18 transferring the toner image of each color of yellow (Y), magenta (M), cyan (C) and black (B) in multiplex is then separated from the paper sheet conveying belt 17 by rigidity (so-called firmness) provided by the paper sheet 18 itself. Thereafter, the paper sheet 18 is conveyed to a fixing device 29 along a conveying path 28. The toner image of each color is then fixed onto the paper sheet 18 by heat and pressure using the fixing device 29. The above paper sheet conveying belt 17 and the fixing device 29 are closely arranged. The paper sheet 18 separated from the paper sheet conveying belt 17 is conveyed to the fixing device 29 by conveying force of the paper sheet conveying belt 17. In this fixing device 29, a heating roll 45 (heating member) is rotated and operated. The heating roll 45 and a fixing belt 46 (driven member) come in contact in a state coming in press contact with each other. Thus, the fixing belt 46 is driven and rotated. The paper sheet 18 is then conveyed by using a nip area N (contact area) formed between these heating roll 45 and fixing belt 46. When the paper sheet 18 passes this area, fixing processing is constructed so as to be performed by heat and pressure. Thereafter, as shown in FIGS. 2 and 3, the paper sheet 18 fixing the toner image of each color is discharged by a discharging roll 32 in a state in which a print face is located downward on a discharging tray 33 arranged in an upper portion of the full color printer main body 1. A print operation is then terminated.

In the above full color printer, it is not limited to an image of a full color, but an image of a predetermined desirable color such as a monochromatic image, etc. can be printed. In accordance with the color of the printed image, the toner image is formed by all of yellow (Y), magenta (M), cyan (C) and black (B) or partial image forming sections 7Y, 7M, 7C, 7B.

In FIG. 2, reference numeral 34 designates an operation panel having a display portion of a liquid crystal panel, etc. attached to a front face of the printer main body 1. The operation panel 34 is constructed so as to display a state of a printer and perform a required operation, etc.

The fixing device in accordance with this exemplary embodiment mode is constructed so as to have a heating member, a driven member, a biasing unit, a contact area forming member, a support member and a fulcrum. The heating member is rotated in a state heated by a heating unit. The driven member is rotated by the above heating member, and conveys a sheet in cooperation with the heating member. The biasing unit biases the above heating member and the above driven member in a contacting direction. The contact area forming member forms a contact area of the heating member and the driven member by making the above heating member and the above driven member come in contact with each other. The support member supports at least one of the above heating member and the above driven member so as to be freely moved in a direction approaching and separated with respect to the other member. The fulcrum is arranged in the downstream side of the above contact area in a sheet conveying direction, and movably supports the above support member.

Figure 4:
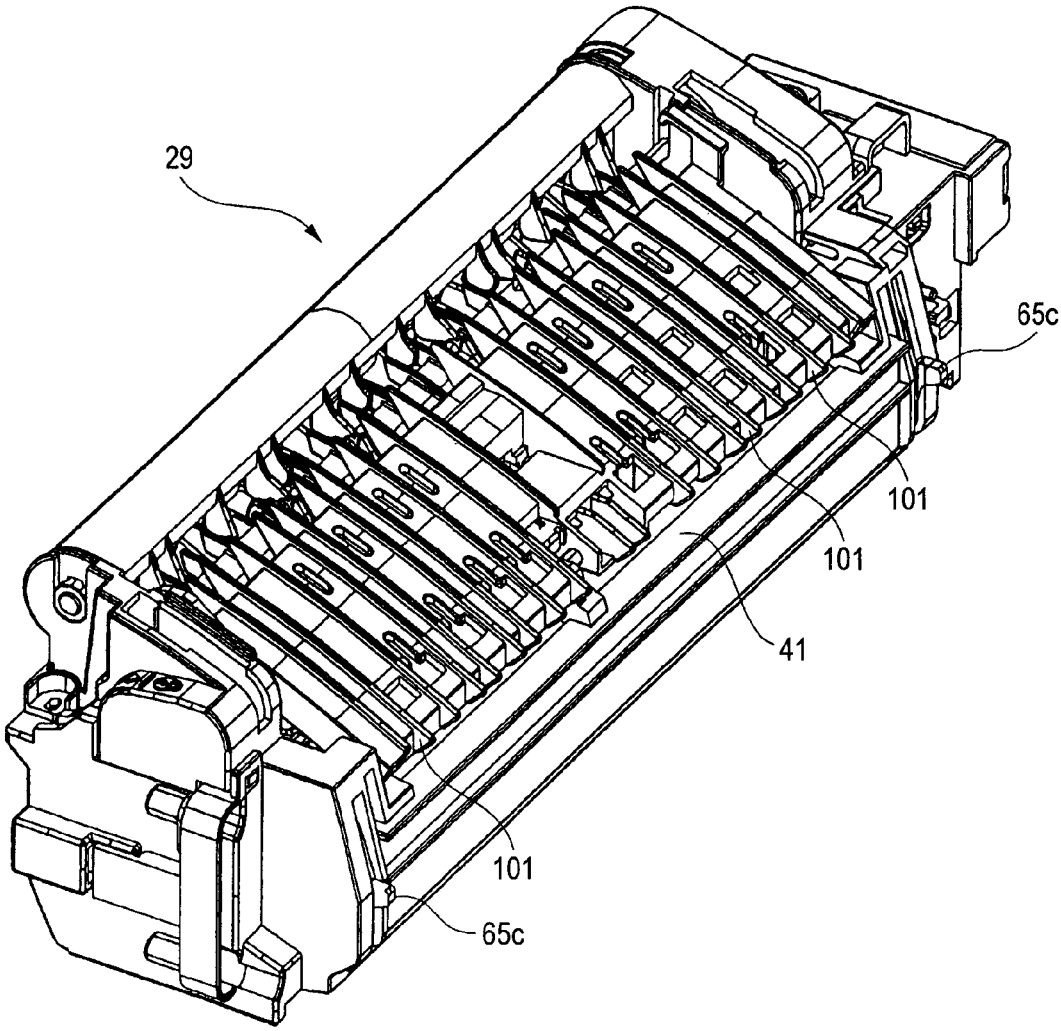
FIG. 4 illustrates an external appearance perspective view showing the fixing device in accordance with exemplary embodiment mode 1 of this invention.
Figure 5:
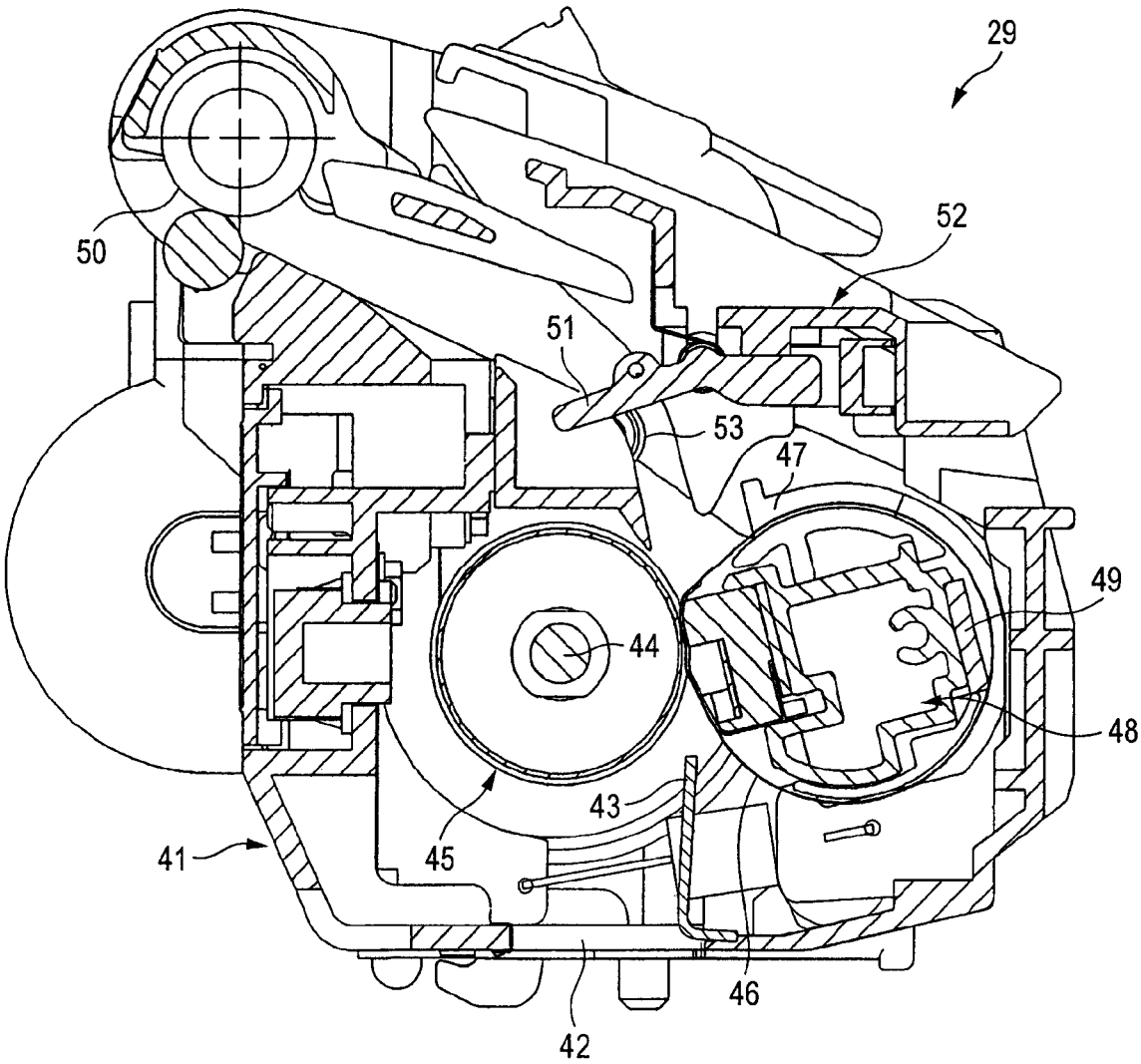
FIG. 5 illustrates a sectional construction view showing the fixing device in accordance with exemplary embodiment mode 1 of this invention.

FIG. 4 is a perspective view showing the external appearance of the fixing device in accordance with this exemplary embodiment mode. FIG. 5 is a cross-sectional view showing the fixing device in accordance with this exemplary embodiment mode.

In the fixing device 29 in accordance with this exemplary embodiment mode, as shown in FIG. 4, its outer circumference is covered with a fixing device housing 41 constructed by synthetic resin, etc. of a heat resisting property. In the outer circumference of the fixing device housing 41, many fins 101 for heat radiation for effectively emitting heat to its upper end face, etc., and raising mechanical strength are arranged.

As shown in FIG. 5, an introducing port 42 in which the paper sheet 18 transferring an unfixed toner image from a downward direction is introduced from the downward direction of the vertical direction to an upward direction, is opened to a lower end face of the above fixing device housing 41. Further, a guide member 43 of a flat plate shape for guiding the paper sheet 18 in a state coming in contact with a rear face side transferring no toner image of the paper sheet 18 is arranged in one side (right-hand side in the illustrated example) of the introducing port 42.

Further, as shown in FIG. 5, a heating roll 45 as a heating member, a fixing belt 46 as a driven member, a belt support member 47 (see FIG. 7), a press contact member 48 and a felt member 49 of a heat resisting property as a liquid shape lubricant supply member are constructed so as to be arranged within the above fixing device housing 41. The heating roll 45 has a heating source 44. The belt support member 47 supports both ends of the fixing belt 46 so as to freely rotate the above fixing belt 46. The press contact member 48 is arranged within the above fixing belt 46, and makes the fixing belt 46 come in press contact with the surface of the above heating roll 45, and forms a nip area N. The felt member 49 supplies a liquid shape lubricant such as silicon oil, etc., onto an inner face of the above fixing belt 46.

In FIG. 5, reference numerals 50, 51 and 53 respectively designate an outlet roll of the fixing device 29, an actuator of a jam sensor 52 for detecting the paper sheet 18 within the fixing device 29, and a guide roller for guiding the paper sheet 18 and arranged near the actuator 51.

Figure 6:
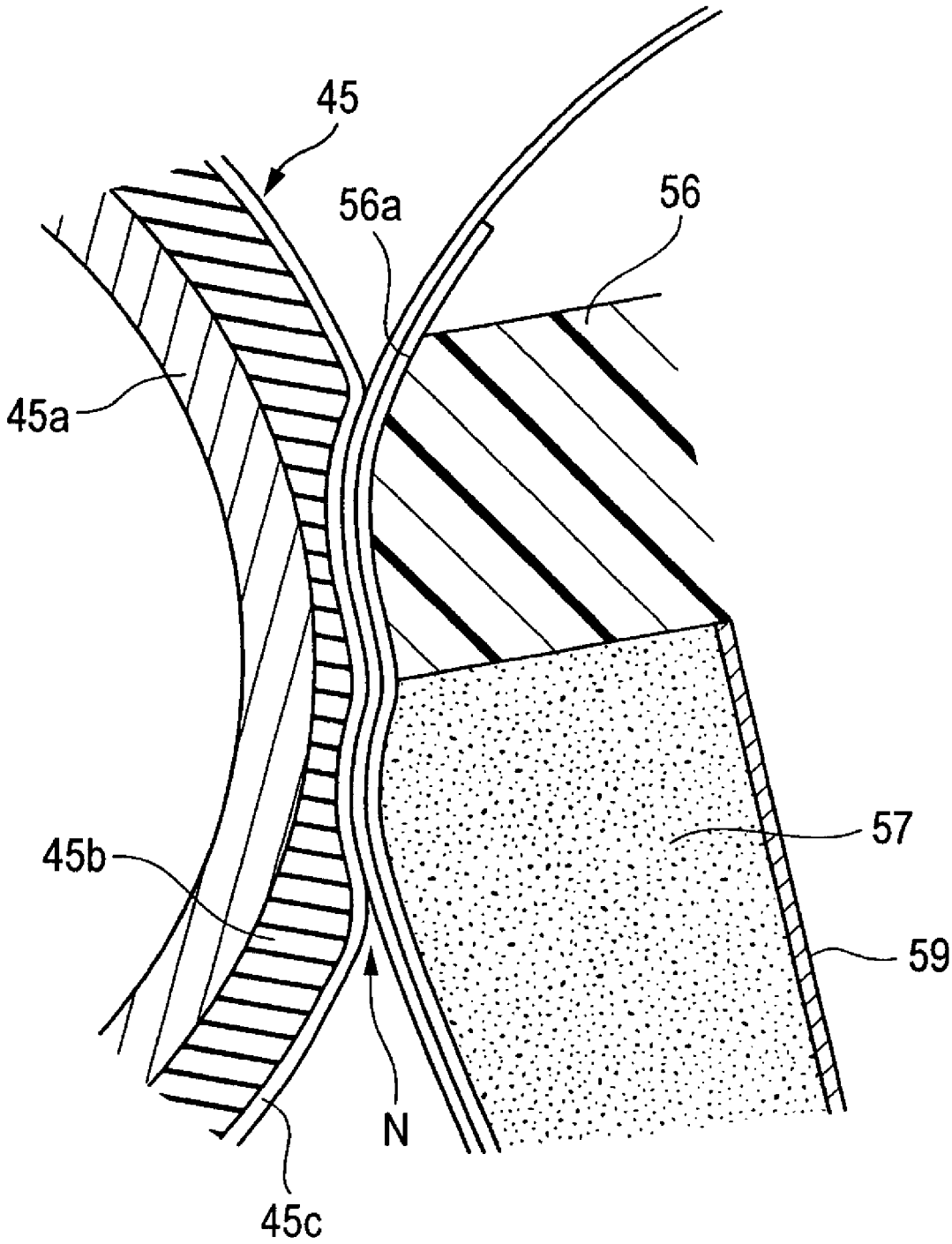
FIG. 6 illustrates a cross-sectional view showing a nip area of a heating roll and a fixing belt.

As shown in FIG. 6, the above heating roll 45 is constructed from a cored bar 45*a* of a thin cylindrical shape formed by iron, stainless steel, etc., an elastic layer 45*b* of about 0.65 mm in wall thickness constructed by silicon rubber, etc. thinly covered on the surface of the cored bar 45*a*, and a mold releasing layer 45*c* of about 30 μm in wall thickness constructed by PFA, etc. and very thinly covered on the surface of the elastic layer 45*b*. Further, as shown in FIG. 5, for example, a halogen lamp 44 of about 650 W is arranged within the above heating roll 45 as a heating source.

Further, for example, the above fixing belt 46 is formed in a cylindrical endless belt shape of about 75 μm in wall thickness by synthetic resin of polyimide, etc. In accordance with necessity, a mold releasing layer constructed by PFA, etc. is arranged on the surface of the fixing belt 46.

Figure 7:
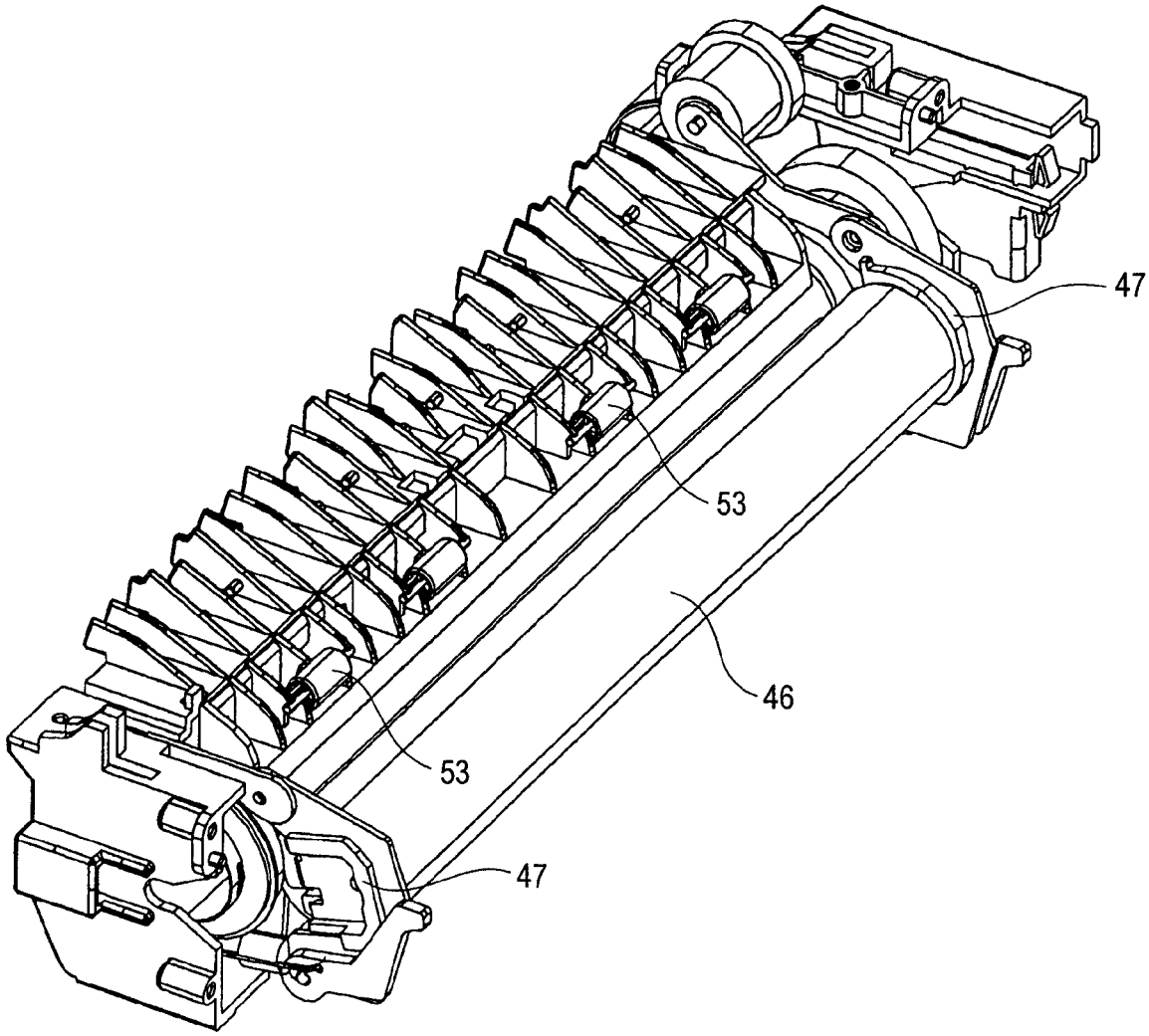
FIG. 7 illustrates an external appearance perspective view showing the interior of the fixing device in accordance with exemplary embodiment mode 1 of this invention.
Figure 8:
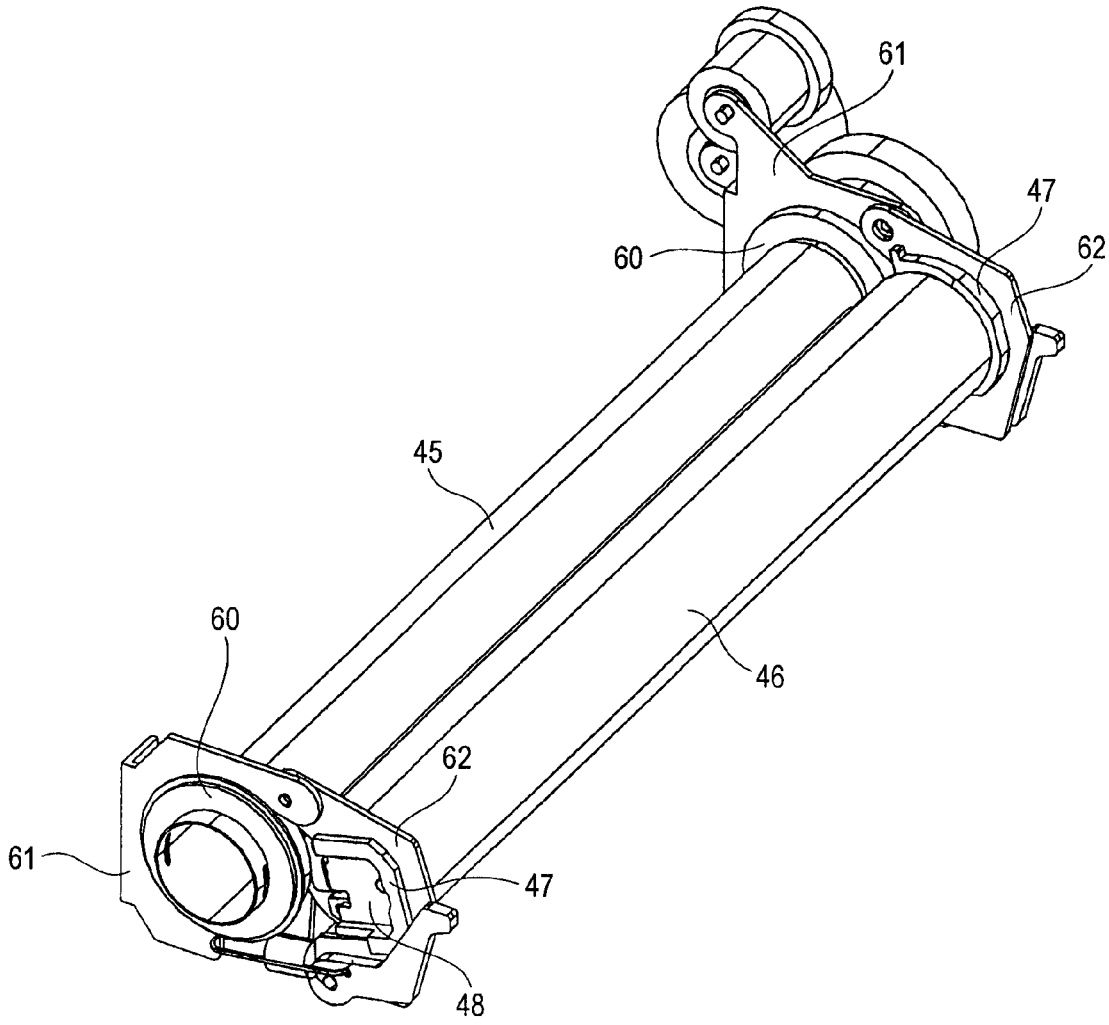
FIG. 8 illustrates an external appearance perspective view showing a press contact state of the heating roll and the fixing belt.

Further, as shown in FIGS. 7 and 8, the above belt support member 47 is constructed so as to be integrally assembled into both end portions of the press contact member 48.

Figure 9:
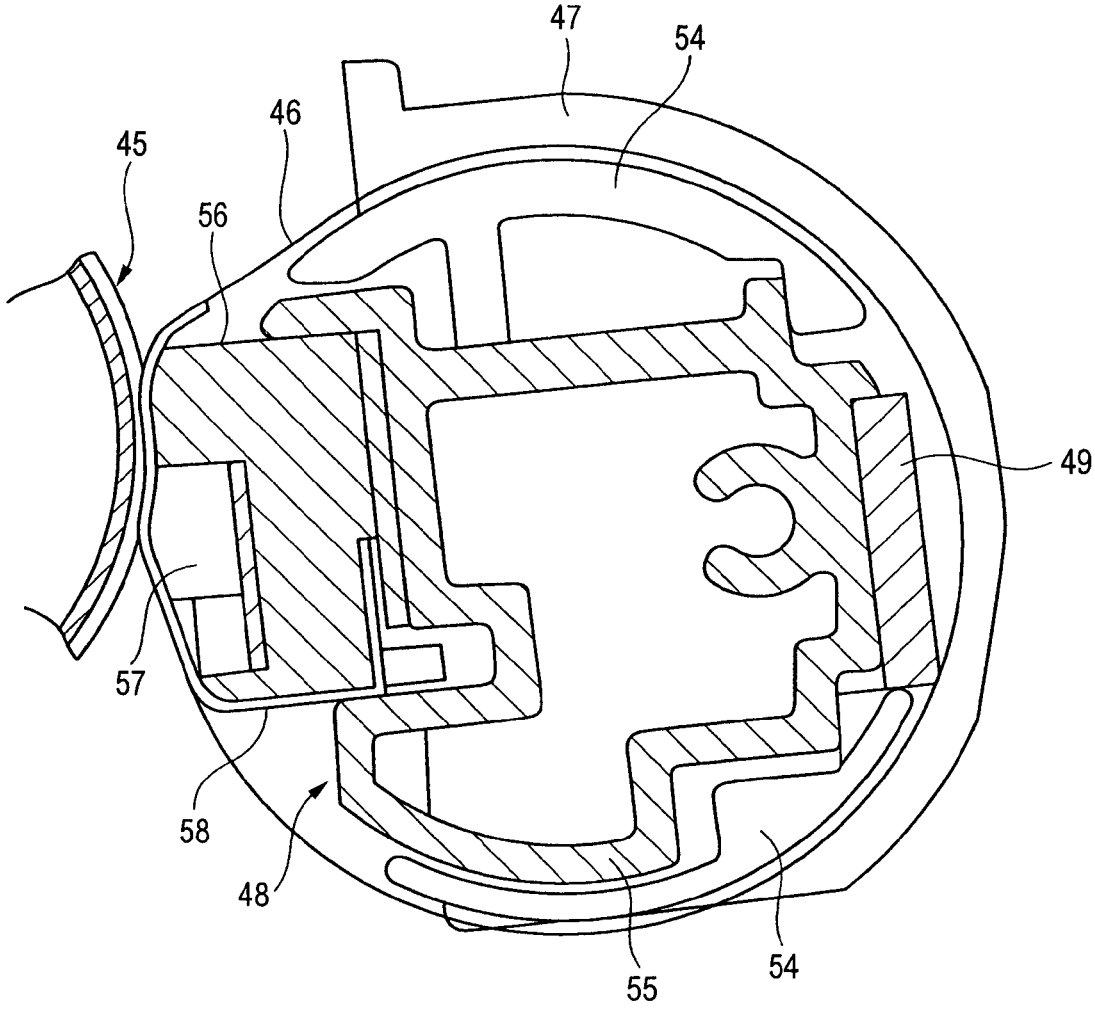
FIG. 9 illustrates a cross-sectional view showing a pressing member of the fixing device in accordance with exemplary embodiment mode 1 of this invention.

As shown in FIG. 9, this press contact member 48 is mainly constructed from a belt housing 54, a belt frame 55, a nip head member 56 (contact area forming member), a pad member 57 (contact area forming member), and a friction reducing sheet 58. The belt housing 54 is manufactured by synthetic resin and guides an outer circumference of the fixing belt 46 while holding this outer circumference. The belt frame 55 is manufactured by a metal and is constructed by aluminum, etc. of an approximately rectangular shape in section mounted to the interior of the belt housing 54 in a fitting state. The nip head member 56 is constructed by synthetic resin, a metal, etc. for making the fixing belt 46 come in press contact with the heating roll 45. The pad member 57 is constructed by an elastic body of synthetic rubber, etc. mounted to the nip head member 56. The friction reducing sheet 58 covers outer circumferences of the nip head member 56 and the pad member 57. This friction reducing sheet 58 is arranged over a predetermined length along an inner face of the fixing belt 46 in a state in which its base end portion is nipped and supported on a rear face side of the nip head member 56, and its tip portion covers the surfaces of the pad member 57 and the nip head member 56. The friction reducing sheet 58 is a sheet shape member for reducing friction between the fixing belt 46, the pad member 57 and the nip head member 56.

Figure 10:
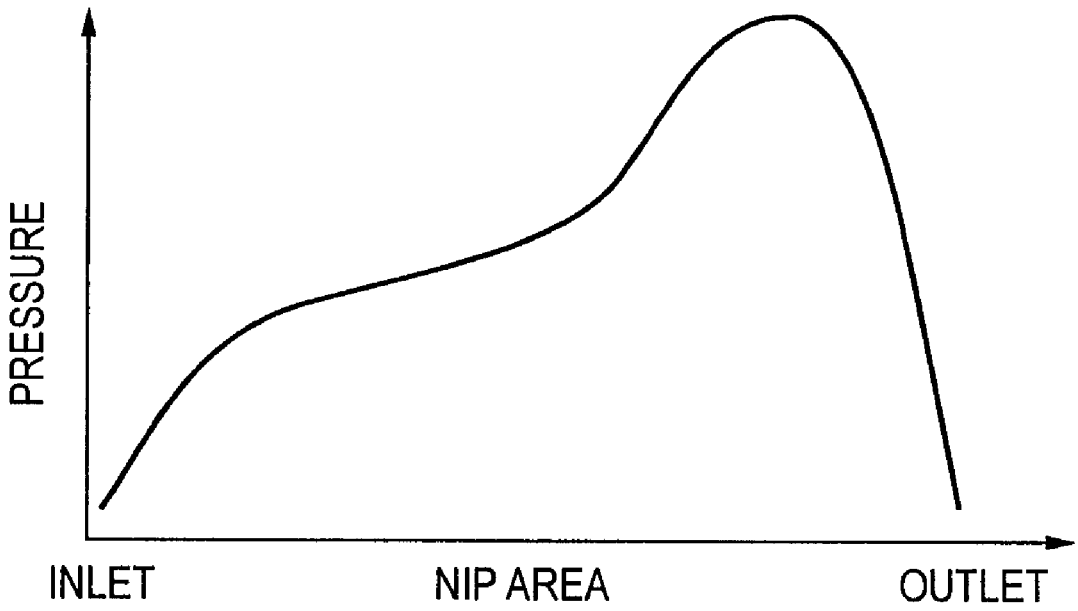
FIG. 10 illustrates a graph showing a pressure distribution in the nip area.

As described later, the above press contact member 48 is biased so as to come in press contact with the heating roll 45 through the fixing belt 46. As shown in FIG. 6, the nip head member 56 and the pad member 57 of the press contact member 48 come in press contact with the surface of the heating roll 45. Thus, a nip area N is constructed so as to be formed between the heating roll 45 and the fixing belt 46. In this case, a tip portion 56*a* of the above nip head member 56 constitutes a separating function portion formed in an R-shape having a predetermined curvature radius. The pad member 57 supported in the metallic plate 59 is constructed so as to come in press contact with the heating roll 45 at a predetermined pressure. As shown in FIG. 10, a pressure distribution in the nip area N is set so as to locally raise an outlet portion of the nip area N The paper sheet 18 passing the above nip area N is elastically deformed so as to become a concave shape toward the fixing belt 46 side along the tip portion 56*a* of the nip head member 56 in the outlet portion of the nip area N. The paper sheet 18 is separated by a curvature change of the nip head member 56 in the above separating function portion and firmness (rigidity) of the paper sheet 18 itself in the outlet portion of the nip area N.

Further, as shown in FIGS. 7 and 8, the above belt support member 47 is mounted to both end portions of the belt housing 54 in a state fitted to both end portions of the belt frame 55.

Figure 1:
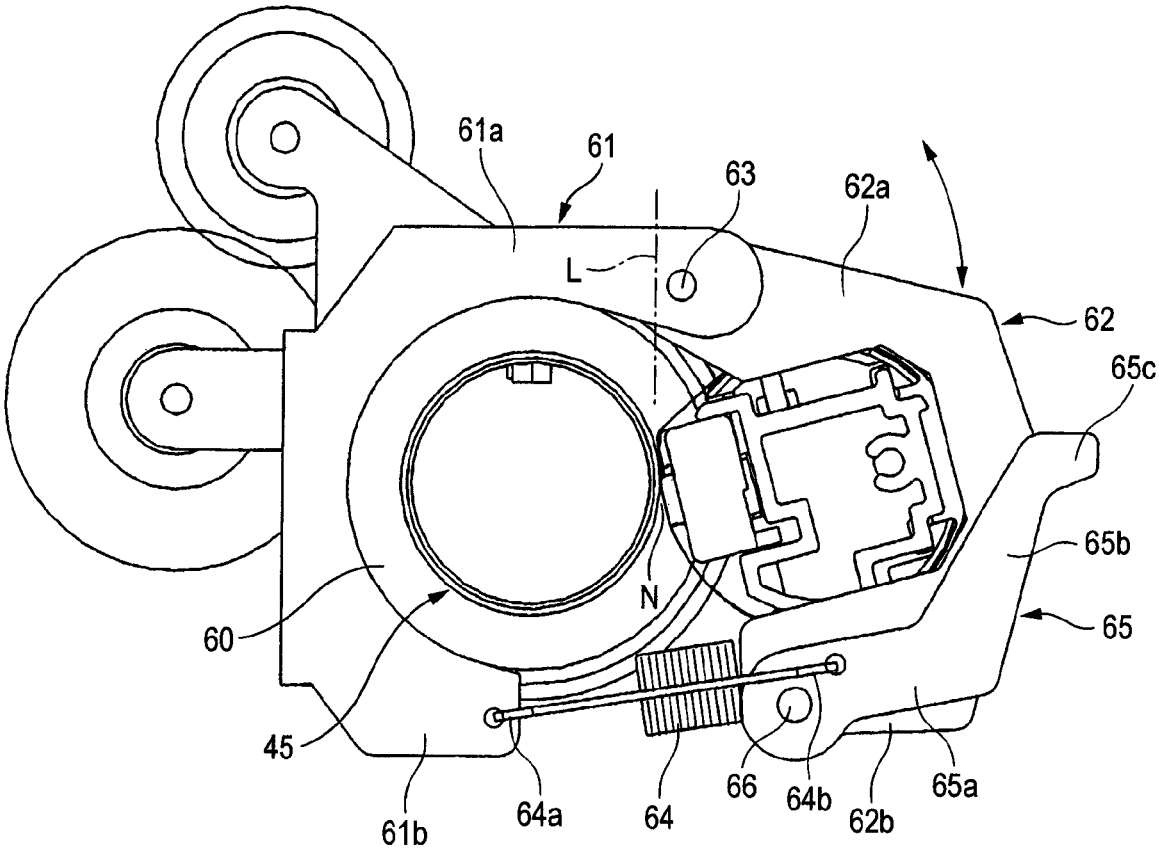
FIG. 1 illustrates a side constructional view showing a fixing device in accordance with exemplary embodiment mode 1 of this invention.

In the above heating roll 45, as shown in FIG. 8, its both end portions are respectively rotatably attached to a first support frame 61 as a support member through a bearing member 60. In the above first support frame 61, as shown in FIG. 1, its side face shape is approximately formed in an L-character shape, and an upper end portion 61*a* located in an upward direction of the heating roll 45 is formed so as to be longer than a lower end portion 61*b* located in a downward direction of the heating roll 45. As shown in FIG. 1, the upper end portion 61*a* of the above first support frame 61 exceeds the nip area N from the heating roll 45 side and is extended until the fixing belt 46 side. In contrast to this, its lower end portion 61*b* is shortly set from a left-hand side face of the heating roll 45 to an approximately central portion.

On the other hand, in the above fixing belt 46, as shown in FIG. 8, its both end portions are rotatably supported by the belt support member 47. As shown in FIG. 1, this belt support member 47 is attached in a state fixed to a second support frame 62 as a support member. In the above second support frame 62, as shown in FIG. 1, its side face shape is approximately formed in a U-character shape, and portions 62*a*, 62*b* located on both upper and lower sides of the fixing belt 46 are approximately extended in parallel with a portion located on a right-hand side face of the fixing belt 46. Further, in the above second support frame 62, its upper end portion 62*a* is set to be slightly longer than a lower end portion 62*b*. A tip 62*a* of this upper end portion is located in an upward direction of the nip area N.

Further, the above first support frame 61 and second support frame 62 are rotatably connected by a connecting pin 63 as a fulcrum in positions slightly shifted on the fixing belt 46 side from the nip area N on an outlet side of the nip area N.

In this exemplary embodiment mode, the fulcrum 63 is arranged so as to be close to an extension line L along an advancing direction of the paper sheet 18 passing the nip area N.

Further, in this exemplary embodiment mode, upper end portions 61*a*, 62*a* of the first support frame 61 and the second support frame 62 are approximately horizontally arranged, and the fulcrum 63 is arranged so as to be comparatively close to the nip area N. However, if it is considered that these first support frame 61 and second support frame 62 function as a lever with the fulcrum 63 as a center, it is desirable to arrange the fulcrum 63 in the upward direction within FIG. 1 separated from the nip area N.

In this exemplary embodiment mode, the first support frame 61 attaching the heating roll 45 is attached in a state fixed to the fixing device housing 41. The second support frame 62 is freely rotated with the connecting pin 63 as a fulcrum such that the second support frame 62 approaches the first support frame 61 and is separated from the first support frame 61. However, the first support frame 61 side may be also constructed so as to be freely moved, and both the first and second support frames 61, 62 may be also constructed so as to be freely moved.

Further, in the above first support frame 61 and second support frame 62, the tip of a lower end portion located on a side opposed to the fulcrum 63 through the nip area N, i.e., an inlet side of the nip area N is biased in a direction mutually approximate by a tension spring 64 as a biasing unit. The heating roll 45 attached to the first support frame 61 and the fixing belt 46 attached to the second support frame 62 are constructed so as to come in press contact with each other by a predetermined press contact force.

In this case, one end 64*a* of the above tension spring 64 is directly connected and fixed to the tip of the first support frame 61. However, the other end 64*b* of the tension spring 64 is not directly connected to the tip of the second support frame 62, but is connected to a base end portion 65*a* of a nip releasing lever 65 as a releasing unit rotatably attached to the tip of the second support frame 62.

As shown in FIG. 1, the base end portion 65*a* of the nip releasing lever 65 is rotatably attached to the tip of the above second support frame 62 through a rotating shaft 66. The other end 64*b* of the tension spring 64 is connected to the vicinity of a pivotal portion 66 of the nip releasing lever 65. The base end portion 65*a* of the above nip releasing lever 65 is approximately horizontally extended from the pivotal portion 66. An intermediate portion 65*b* of the nip releasing lever 65 is slantingly arranged so as to form an angle greater than 90 degrees with respect to the base end portion 65*a*. A tip portion 65*c* of the nip releasing lever 65 is shortly projected approximately in the horizontal direction.

As shown in FIG. 4, the tip portion 65*c* of the above nip releasing lever 65 is projected on a side of the fixing device housing 41. The nip releasing lever 65 is rotated in the counterclockwise direction by pushing the tip portion 65*c* of the nip releasing lever 65 upward by a user. Thus, the other end 64*b* of the tension spring 64 is moved to the heating roll 45 side, and is constructed so as to release a pressurizing state of the heating roll 45 and the fixing belt 46. Accordingly, when a jam of the paper sheet 18 is generated within the fixing device 29, etc., the user operates the nip releasing lever 65 and releases the pressurizing state of the heating roll 45 and the fixing belt 46. Thus, the paper sheet 18 generating the jam can be easily removed.

In the above construction, generation of a separating defect is prevented as follows even in a fixing case of a thick sheet irrespective of the kind of a recording sheet in the full color printer applying the fixing device in accordance with this exemplary embodiment mode. Further, a driving unit, etc. that changes a state of a contact area are not required, and the device can be made compact.

Namely, in the color printer using the fixing device in accordance with this exemplary embodiment mode, as shown in FIG. 2, the toner image of each color is respectively formed by four image forming sections 7Y, 7M, 7C, 7B of yellow (Y), magenta (M), cyan (C) and black (B) The toner image of each color of yellow (Y), magenta (M), cyan (C) and black (B) formed by these four image forming sections 7Y, 7M, 7C, 7B is transferred in multiplex onto the paper sheet 18 moved in a state adsorbed to the paper sheet conveying belt 17.

As shown in FIG. 2, the paper sheet 18 transferring the toner image of each color of these yellow (Y), magenta (M), cyan (C), black (B), etc. in multiplex is conveyed to the fixing device 29. After fixing processing is performed by the fixing device 29, the paper sheet 18 is discharged onto the paper discharging tray 33 arranged in an upper portion of the printer main body 1.

As shown in FIG. 5, the above paper sheet 18 is introduced into the interior of the fixing device housing 41 from the introducing port 42 arranged in a lower end portion of the fixing device 29 in a state guided by the guide member 43. The paper sheet 18 is then conveyed to the nip area N in which the heating roll 45 and the fixing belt 46 come in press contact. As shown in FIG. 1A, this recording paper sheet 18 is then heated by the heating roll 45 in the nip area N, and is pressurized by press contact force of the heating roll 45 and the fixing belt 46. The toner image transferred onto the paper sheet 18 is melted and fixed.

In this case, on the surface of the above heating roll 45, press contact is made at large pressure by the tip portion 56*a* of the nip head member 56 in a pressing member for pressing the fixing belt 46 in an outlet of the nip area N. The elastic layer 45*b* of the heating roll 45 is elastically deformed in a concave shape. Therefore, the paper sheet 18 is also deformed in a concave shape in accordance with this elastic deformation. Thus, the paper sheet 18 is separated from the surface of the heating roll 45 by firmness of the paper sheet 18 and the action of a separating function portion.

Figure 11A:
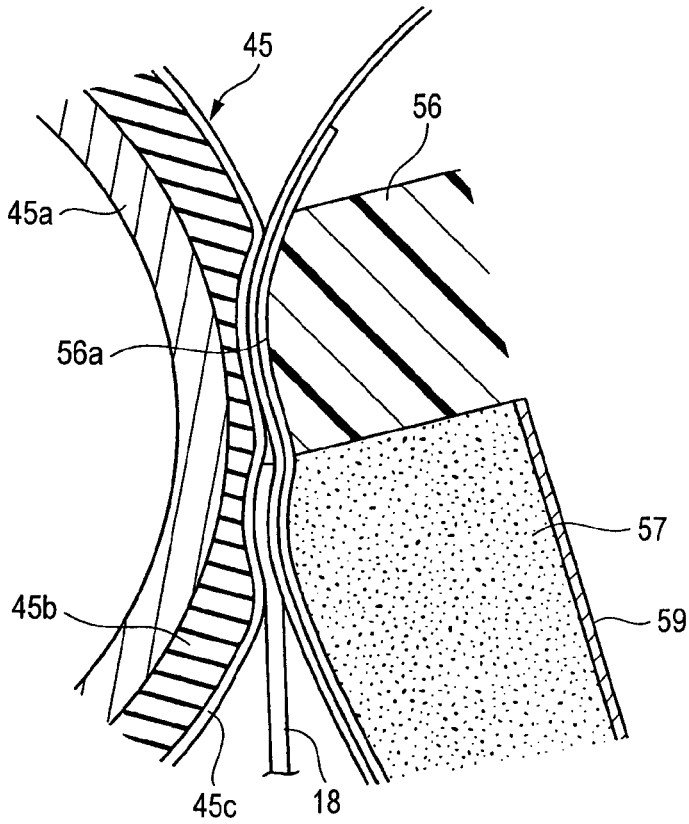
FIGS. 11A and 11B illustrate cross-sectional views showing states in which a paper sheet passes the nip area of the heating roll and the fixing belt.
Figure 11B:
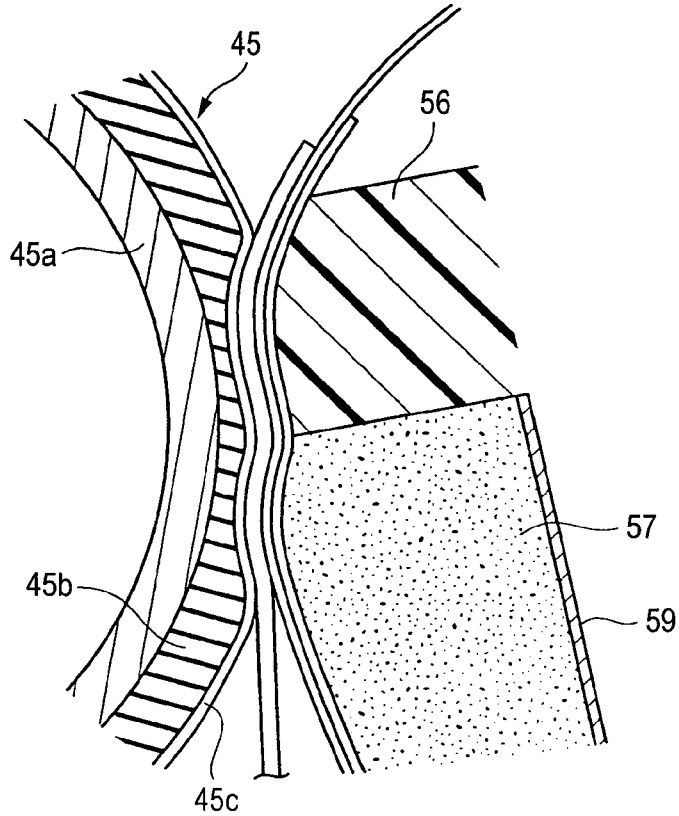
Figure 12:
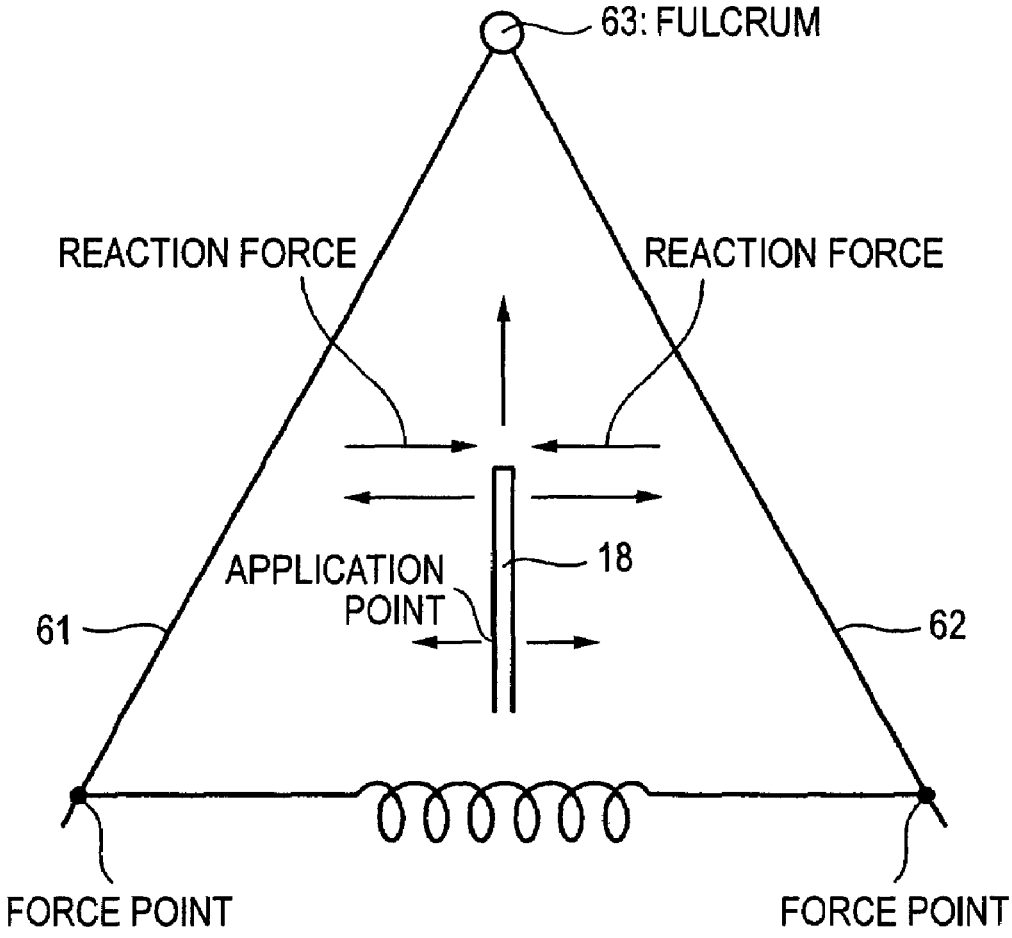
FIG. 12 illustrates a typical view showing the operation of the fixing device in accordance with exemplary embodiment mode 1 of this invention.

On the other hand, when the above paper sheet 18 is thick paper such as coat paper, a postcard, etc., and the paper sheet 18 is advanced to the nip area N of the heating roll 45 and the fixing belt 46 as shown in FIG. 11A, a fulcrum 63 is arranged in the downstream side of the nip area N (outlet side) in the paper sheet conveying direction as typically shown in FIG. 12 with the first and second support frames 61, 62 as a lever of a straight line shape. Therefore, force of a direction for making the heating roll 45 and the fixing belt 46 come in contact is given to the heating roll 45 and the fixing belt 46 by thickness of the paper sheet 18. As shown in FIG. 11B, since a tip portion of the nip head member 56 is then rotated and pressed, the operation of the separating function portion is performed. Accordingly, the paper sheet 18 passing the nip area N is not easily curled on the heating roll 45 side.

Figure 13:
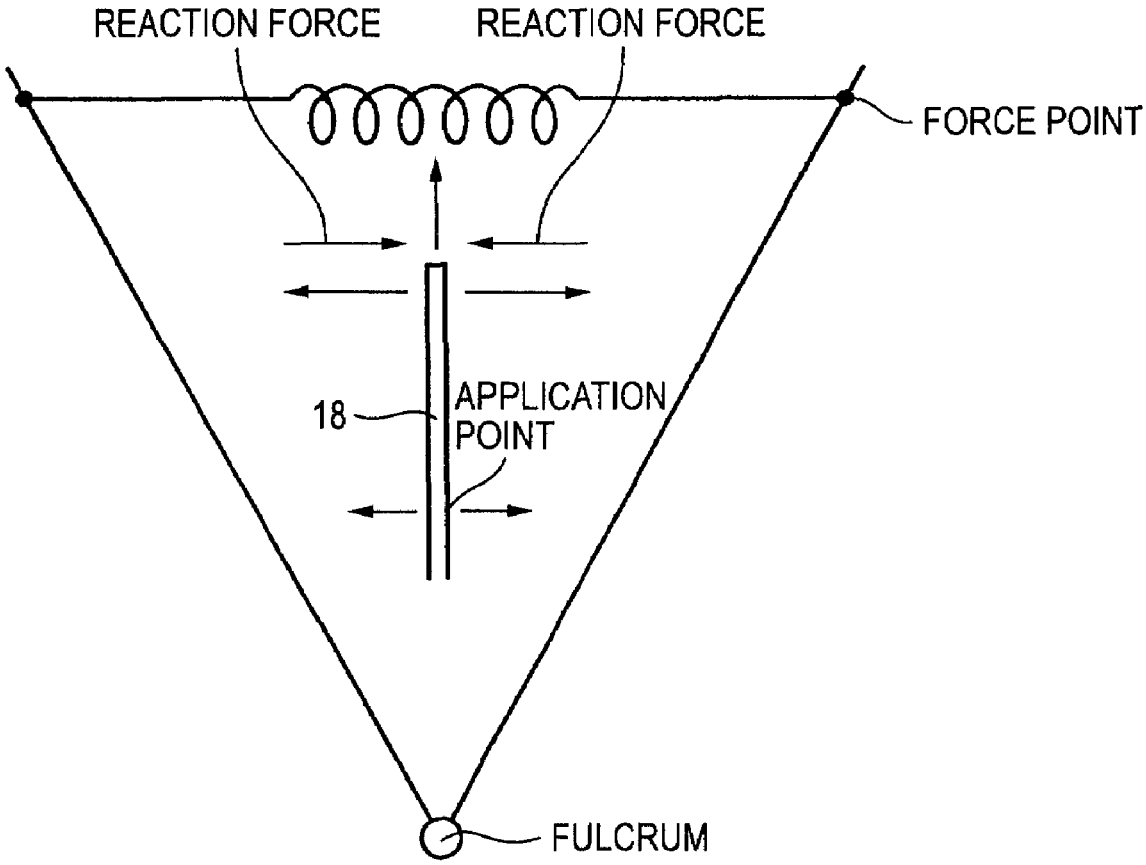
FIG. 13 illustrates a typical view showing the operation of a conventional fixing device.

On the other hand, as shown in FIG. 13, when the fulcrum is arranged in an inlet side of the nip area N, thick paper is advanced to the nip area N so that force of a direction for releasing the press contact of the heating roll 45 and the fixing belt 46 is given. Further, the tip portion 56*a* of the nip head member 56 is rotated in a direction separated from the heating roll 45. Therefore, the operation of the separating function portion relatively becomes weak.

Accordingly, when fixing processing is performed in the paper sheet 18 constructed by the above thick paper, no paper sheet 18 is easily discharged from the fixing processing in a state curled so as to be wound on the heating roll 45 side by adhesive force, etc. of the toner image fixed to the paper sheet 18. Accordingly, as shown in FIGS. 2 and 3, the paper sheet 18 discharged onto the discharging tray 33 is also preferably stacked. There is no fear that a stacking state of the paper sheet 18 is disturbed and a discharging defect is generated and the paper sheet 18 discharged onto the discharging tray 33 falls off from the discharging tray 33.

For example, the thick paper is a paper sheet of 160 gms or more in basis weight but is not limited to this paper sheet. There may be also a case including a paper sheet of a basis weight less than 160 gms as the thick paper.

Exemplary Embodiment 2

Figure 14:
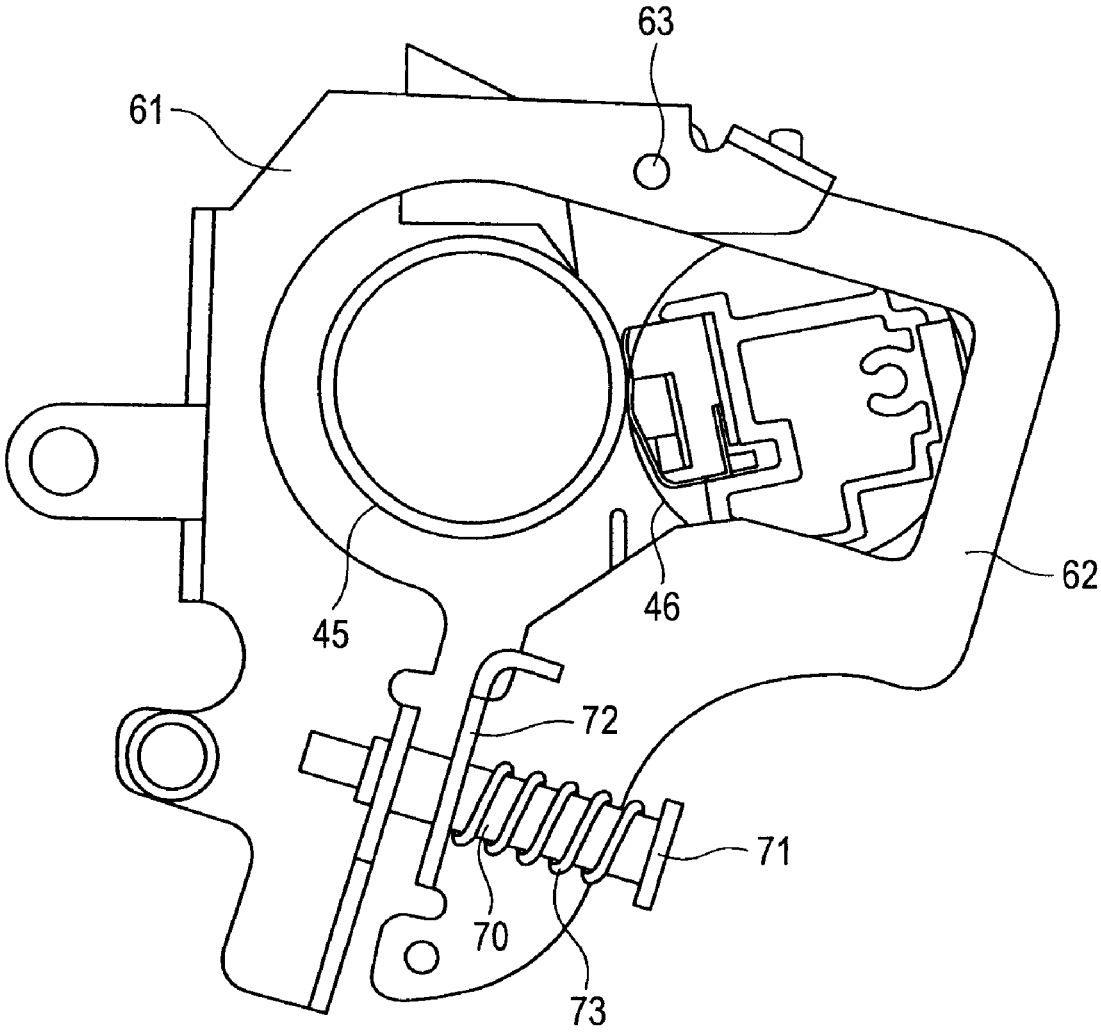
FIG. 14 illustrates a side construction view showing a fixing device in accordance with exemplary embodiment mode 2 of this invention.

FIG. 14 shows exemplary embodiment mode 2 of this invention. The same portions as the above exemplary embodiment mode 1 are designated by the same reference numerals, and their explanations will be made. In this exemplary embodiment mode 2, a compression spring arranged in a side opposed to a fulcrum through the nip area N is constructed so as to be used as a biasing unit that makes the above heating member and the above pressurizing member come in press contact with each other.

Namely, in this exemplary embodiment mode 2, as shown in FIG. 14, a pin 70 rises in a state fixed to a first support frame 61. A tip side of the pin 70 is arranged in a second support frame 62 side. A compression spring 73 is interposed between an engaging portion 71 of the tip of the above pin 70 and a pressing portion 72 of the second support frame 62. The first support frame 61 rising the pin 70 and the second support frame 62 receiving extension force of the compression spring 73 in the pressing portion 72 are constructed so as to come in press contact with each other by the extension force of the compression spring 73.

The other constructions and operations are similar to those of the above exemplary embodiment mode 1, and their explanations are therefore omitted.

Exemplary Embodiment Mode 3

Figure 15:
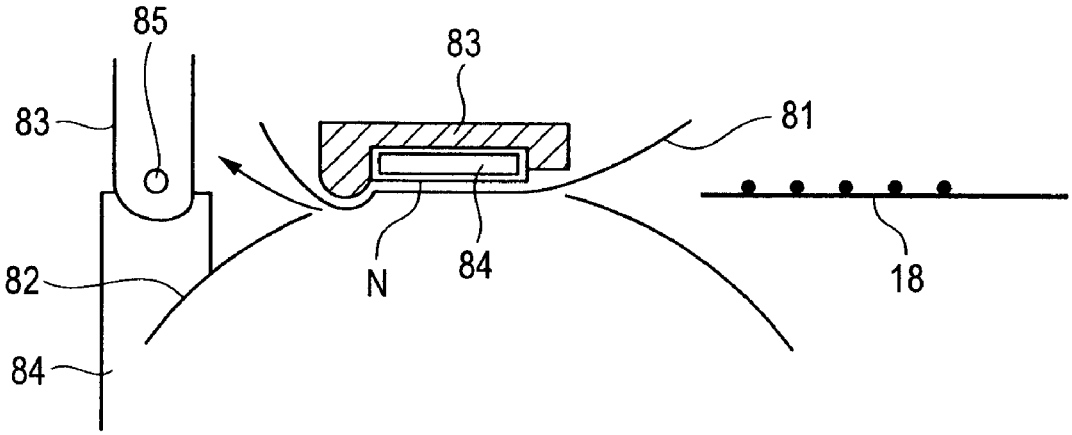
FIG. 15 illustrates a side construction view showing a fixing device in accordance with exemplary embodiment mode 3 of this invention.

FIG. 15 shows exemplary embodiment mode 3 of this invention. The same portions as the above exemplary embodiment mode 1 are designated by the same reference numerals, and will be explained. In this exemplary embodiment mode 3, a belt, a conveying roll, a biasing unit, a contact area forming member, a support member and a fulcrum are constructed so as to be arranged. A heating unit is arranged within the belt. The conveying roll comes in contact with the above belt and operates the belt, and conveys a sheet in cooperation. The biasing unit biases the above belt in a direction coming in contact with the above conveying roll. The contact area forming member forms a contact area of the belt and the conveying roll by making the above belt and the above conveying roll come in contact with each other. The support member movably supports at least one of the above belt and the above conveying roll in a direction approaching and separated with respect to the other member. The fulcrum is arranged in the downstream side of the above contact area in a sheet conveying direction, and movably supports the above support member.

Namely, in this exemplary embodiment mode 3, as shown in FIG. 15, a heating belt 81 is arranged in an upward direction and a pressurizing roll (conveying roll) 82 rotated and operated is arranged in a downward direction. A pressing member 83 (contact area forming member) and a heating member 84 (heating unit) are arranged within the heating belt 81. The pressing member 83 makes the heating belt 81 come in press contact with the pressurizing roll 82, and forms the nip area N. The heating member 84 is arranged on a lower face of the pressing member 83.

Similar to the fixing device shown in FIG. 1, the above heating belt 81 and pressurizing roll 82 come in press contact with each other by a first support frame 83 for supporting the heating belt 81 and a second support frame 84 for supporting the pressurizing roll 82. A fulcrum 85 for rotatably supporting these first support frame 83 and second support frame 84 is arranged in the downstream side (outlet side) of the nip area N in a paper sheet conveying direction.

The other constructions and operations are similar to those of the above exemplary embodiment mode 1, and their explanations are therefore omitted.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A fixing device, comprising:

a heating member that rotates while it is heated by a heating unit;

a driven member that is rotated by the heating member, and that conveys a sheet in cooperation with the heating member;

a biasing unit that biases the heating member and the driven member in a contacting direction;

a contact area forming member that contacts a portion of the driven member and causes the portion of the driven member that is contacted to come in contact with a portion of the heating member;

a support member that supports at least one of the heating member and the driven member so as to be freely moved towards and away from the other member; and a fulcrum that is arranged downstream in a sheet conveying direction from the contacting portions of the heating member and the driven member, and that movably supports the support member, wherein the support member comprises a first support frame and a second support frame, the first support frame being arranged on both end portions in a longitudinal direction of the heating member and the second support frame being arranged on both end portions in a longitudinal direction of the driven member, wherein the first support frame and the second support frame are mutually connected through the fulcrum so as to be freely rotated, and wherein the first support frame supports the heating member and the second support frame supports the driven member.

2. A fixing device, comprising:

a heating roll that rotates while it is heated by a heating unit;

a belt that is rotated by the heating roll, and that conveys a sheet in cooperation with the heating roll;

a biasing unit that biases the belt and the heating roll in a contacting direction;

a contact area forming member that contacts a portion of the belt and causes the portion of the belt that is contacted to come in contact with a portion of the heating roll;

a support member that supports at least one of the heating roll and the belt so as to be freely moved towards and away from the other member; and a fulcrum that is arranged downstream in a sheet conveying direction from the contacting portions of the heating roll and the belt, and that movably supports the support member, wherein the support member comprises a first support frame and a second support frame, the first support frame being arranged on both end portions in a longitudinal direction of the heating roll and the second support frame being arranged on both end portions in a longitudinal direction of the belt, wherein the first support frame and the second support frame are mutually connected through the fulcrum so as to be freely rotated, and wherein the first support frame supports the heating roll and the second support frame supports the belt.

3. A fixing device, comprising:

a belt that has a heating unit therein;

a conveying roll that comes in contact with the belt and operates the belt, and that conveys a sheet in cooperation with the belt;

a biasing unit that biases the belt and the conveying roll in a contacting direction;

a contact area forming member that contacts a portion of the belt and causes the portion of the belt that is contacted to come in contact with a portion of the conveying roll;

a support member that supports at least one of the belt and the conveying roll so as to be freely moved towards and away from the other member; and a fulcrum that is arranged downstream in a sheet conveying direction from the contacting portions of the belt and the conveying roll, and that movably supports the support member, wherein the support member comprises a first support frame and a second support frame, the first support frame being arranged on both end portions in a longitudinal direction of the belt and the second support frame being arranged on both end portions in a longitudinal direction of the conveying roll, wherein the first support frame and the second support frame are mutually connected through the fulcrum so as to be freely rotated, and wherein the first support frame supports the belt and the second support frame supports the conveying roll.

4. The fixing device according to claim 1, wherein the biasing unit comprises a spring that is arranged upstream in the sheet conveying direction from the fulcrum and the contacting portions of the heating member and the driven member.

5. The fixing device according to claim 1, wherein the contact area forming member has a separating function portion located on a downstream side of the contact area forming member in the sheet conveying direction.

6. The fixing device according to claim 1, wherein a portion of the contact area forming member has an R-shape and is located on a downstream side of the contact area forming member in the sheet conveying direction.

7. The fixing device according to claim 1, further comprising:

a releasing unit that is provided on the support member, and that releases a biasing force made by the biasing unit.

8. The fixing device according to claim 1, wherein the fulcrum is arranged closely to an extension line extending along the sheet conveying direction.

9. The fixing device according to claim 1, wherein the heating member has an elastic layer.

10. An image forming apparatus, comprising a fixing device that comprises:

a heating member that rotates while it is heated by a heating unit;

a driven member that is rotated by the heating member, and that conveys a sheet in cooperation with the heating member;

a biasing unit that biases the heating member and the driven member in a contacting direction;

a contact area forming member that contacts a portion of the driven member and causes the portion of the driven member that is contacted to come in contact with a portion of the heating member;

a support member that supports at least one of the heating member and the driven member so as to be freely moved towards and away from the other member; and a fulcrum that is arranged downstream in a sheet conveying direction from the contacting portions of the heating member and the driven member, and that movably supports the support member, wherein the support member comprises a first support frame and a second support frame, the first support frame being arranged on both end portions in a longitudinal direction of the heating member and the second support frame being arranged on both end portions in a longitudinal direction of the driven member, wherein the first support frame and the second support frame are mutually connected through the fulcrum so as to be freely rotated, and wherein the first support frame supports the heating member and the second support frame supports the driven member.

11. The fixing device according to claim 1 wherein a force in a direction for making the heating member and the driven member come in contact is given to the heating member and the driven member by a thickness of the sheet.

* * * * *